US008897664B2

(12) United States Patent
Choi et al.

(10) Patent No.: US 8,897,664 B2
(45) Date of Patent: Nov. 25, 2014

(54) DEVELOPING CARTRIDGE HAVING A DETACHABLE STRUCTURE WITH RESPECT TO A BODY OF AN IMAGE FORMING APPARATUS, AND AN IMAGE FORMING APPARATUS HAVING THE SAME

(75) Inventors: Mun Hyub Choi, Suwon-si (KR); Sung Kyun Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 211 days.

(21) Appl. No.: 13/551,985

(22) Filed: Jul. 18, 2012

(65) Prior Publication Data

US 2013/0022367 A1 Jan. 24, 2013

(30) Foreign Application Priority Data

Jul. 21, 2011 (KR) ..... 10-2011-0072272

(51) Int. Cl.

*G03G 15/00* (2006.01)
*G03G 21/18* (2006.01)
*G03G 21/16* (2006.01)

(52) U.S. Cl.

CPC ..... *G03G 21/1867* (2013.01); *G03G 2221/166* (2013.01); *G03G 21/1652* (2013.01); *G03G 2221/1684* (2013.01); *G03G 2221/169* (2013.01); *G03G 21/1633* (2013.01)

USPC ..... 399/90; 399/110

(58) Field of Classification Search

USPC ..... 399/90, 110, 111

See application file for complete search history.

(56) References Cited

U.S. PATENT DOCUMENTS

| | | | | |
|---|---|---|---|---|
| 7,711,282 | B2 * | 5/2010 | Okabe | 399/90 |
| 7,761,024 | B2 * | 7/2010 | Imaizumi et al. | 399/90 |
| 2007/0160380 | A1 | 7/2007 | Imaizumi et al. | |
| 2010/0329757 | A1 | 12/2010 | Souda | |

FOREIGN PATENT DOCUMENTS

| | | |
|---|---|---|
| JP | 2004-347728 | 12/2004 |
| JP | 2009-3413 | 1/2009 |
| JP | 2009-116315 | 5/2009 |
| KR | 10-2008-0112100 | 12/2008 |
| KR | 10-2010-0022207 | 3/2010 |

OTHER PUBLICATIONS

European Search Report issued Nov. 6, 2012 in corresponding European Patent Application No. 12176728.9.

* cited by examiner

*Primary Examiner* — William J Royer
(74) *Attorney, Agent, or Firm* — Staas & Halsey LLP

(57) ABSTRACT

An image forming apparatus includes a body, at least one developing cartridge, which is disposed inside the body to form an image and is provided at one side thereof with an interface terminal to receive a power, a tray movably coupled to the body while accommodating the at least one developing cartridge, a cover coupled to one side to open/close the body such that the tray moves to outside the body, a link member configured to guide the movement of the tray and to move according to the open/close movement of the cover while being connected to the cover, and a connection terminal configured to make contact with the interface terminal by being pressed by the link member when the cover closes the body and to be separated from being released for pressing force when the cover opens the body.

27 Claims, 10 Drawing Sheets

DEVELOPING CARTRIDGE HAVING A DETACHABLE STRUCTURE WITH RESPECT TO A BODY OF AN IMAGE FORMING APPARATUS, AND AN IMAGE FORMING APPARATUS HAVING THE SAME

CROSS-REFERENCE TO RELATED APPLICATIONS

This application claims the benefit of Korean Patent Application No. 10-2011-0072272, filed on Jul. 21, 2011 in the Korean Intellectual Property Office, the disclosure of which is incorporated herein by reference.

BACKGROUND

1. Field

Embodiments of the present disclosure relate to a developing cartridge and an image forming apparatus having the same, and more particularly, to a developing cartridge having a detachable structure with respect to a body of an image forming apparatus, and an image forming apparatus having the same.

2. Description of the Related Art

An image forming apparatus is a device which forms an image on a printing medium according to an input signal. A printer, a copier, a facsimile, and a multi-function printer which integrates the function of the printer, the copier, and the facsimile are applicable to the image forming apparatus.

An electro-photographic image forming apparatus, a type of the image forming apparatus, is provided with a developing cartridge, which accommodates a photoconductor and a developing apparatus, and an optical scanning unit. The optical scanning unit forms an electrostatic latent image on the surface of the photoconductor by scanning a laser on the photoconductor which is charged with a predetermined electric potential, and the developing apparatus forms a visible image by supplying a developer on the photoconductor at where the electrostatic latent image is formed.

The photoconductor and the developing apparatus included in the developing cartridge are connected to a power supply unit provided at a body of the image forming apparatus in a state of being installed on the body to receive a driving power needed for forming an image.

A developing cartridge is coupled to a tray that is movably coupled to the body of the image forming apparatus, and then the developing cartridge is installed to the body through the tray. In this case, the developing cartridge is provided at one side with an interface terminal that is electrically connected to the photoconductor and the developing apparatus included in the developing cartridge. The tray is provided with an intermediate terminal that makes contact with the interface terminal in a process of coupling the developing cartridge to the tray. The body is provided with a connection terminal that makes contact with the intermediate terminal in a process of installing the developing cartridge to the body through the tray. The connection terminal is connected to the power supply unit, and the power which is supplied through the power supply unit is supplied to the photoconductor, the developing apparatus, and the like, through the intermediate terminal and the interface terminal.

Such a power supply structure requires a separate component such as the intermediate terminal to connect the interface terminal of the developing cartridge to the connection terminal at the body, and thus the number of the components increases. Also, the power supply is achieved through two stages of contact, thereby increasing the chance of contact failure.

SUMMARY

Therefore, it is an aspect of the present disclosure to provide a developing apparatus having a simplified electrical connecting structure between a developing cartridge and a power supply unit, which is provided at a body of an image forming apparatus, and the image forming apparatus having the same.

Additional aspects will be set forth in part in the description which follows and, in part, will be obvious from the description, or may be learned by practice of the invention.

In accordance with one aspect, an image forming apparatus includes a body, a cover, a tray, at least one developing cartridge, a connection terminal plate, and a connection terminal. The cover is configured to open/close one side of the body. The tray is installed to the body through the one side open by the cover as to enable a sliding motion in a first direction. The at least one developing cartridge is installed at an inside of the body while being accommodated at the tray and is provided at one side with an interface terminal to be supplied with a power used to form an image. The connection terminal plate is configured to slidably move in a second direction different from the first direction in linkage with an open/close motion of the cover. The connection terminal is coupled to the connection terminal plate such that the connection terminal makes contact with the interface terminal while being pressed by the connection terminal plate when the cover closes the body, and is separated from the interface terminal while being released from a pressing force by the connection terminal plate when the cover opens the body.

The image forming apparatus further includes a guide rail. The guide rail is movably coupled to one side of the body and moves in linkage with the cover while connected to the cover. The connection terminal plate presses the connection terminal or releases a pressing force on the connection terminal while moving in linkage with the guide rail.

The guide rail includes at least one first guide protrusion which protrudes from one side of the guide rail. The connection terminal plate includes at least one first guide slot which accommodates the at least one first guide protrusion such that the at least one first guide protrusion moves in a sliding manner.

The at least one first guide slot includes an inclined unit which is slanted with respect to the first direction to which the guide rail moves.

At least one second guide slot is provided at one side of the body to accommodate and guide the at least one first guide protrusion such that the guide rail moves in the first direction.

The connection terminal plate includes at least one second guide protrusion which protrudes to one side of the connection terminal plate. At least one third guide slot is provided at one side of the body to accommodate and guide the at least one second guide protrusion such that the connection terminal plate moves in the first direction.

The image forming apparatus further includes a power supply unit which is installed on the body to supply a power to the developing cartridge installed at the body. The connection terminal includes a fixed unit which is fixed to the power supply unit, a contact unit which makes contact with the interface terminal while being pressed by the connection terminal plate, and a connection unit which connects the fixed unit to the contact unit.

The connection unit includes a coil spring which is configured to elastically deform to store a force, which is applied to the contact unit when the connection terminal plate presses the contact unit.

The connection terminal plate includes a pressing rib which is configured to press the contact unit or release a pressing force on the contact unit in a process that the connection terminal plate moves while connected to the contact unit.

The contact unit includes a contact point which makes direct contact with the interface terminal, a first arm which is extended from the contact point and is connected to the pressing rib, and a second arm which connects between the connection unit and the contact point.

The first arm rotates on the contact point, and the second arm rotates on the connection unit.

The contact point includes a coil spring which is configured to elastically deform to store a force, which is applied to the first arm when the pressing rib presses the first arm.

The pressing rib includes a first regulation unit which supports a portion of the first arm to regulate a moving direction of the first arm when the first arm rotates on the contact point.

The image forming apparatus further includes a fixing member configured to fix the connection terminal to the body. The fixing member includes a second regulation unit which supports a portion of the second arm to regulate a moving direction of the second arm when the second arm rotates on the connection unit.

In accordance with another aspect of the present disclosure, an image forming apparatus includes a body, a cover, a tray, at least one developing cartridge, a power supply unit and a connection terminal. The cover is configured to open/close one side of the body. The tray is installed to the body through the one side open by the cover as to enable a sliding motion. At least one developing cartridge is installed at an inside of the body while accommodated at the tray and is provided at one side thereof with an interface terminal to be supplied with a power used to form an image. The power supply unit is configured to supply a power to the at least one developing cartridge installed at the body. The connection terminal is connected to the power supply unit and is configured to make contact or to separate from the interface terminal in linkage with the cover. When the cover opens the body, the connection terminal is separated from the interface terminal of the at least one developing cartridge to prevent the connection terminal from interfering with the at least one developing cartridge installed at the tray in a process of moving the tray.

When the cover closes the body, the connection terminal makes contact with the interface terminal such that the power of the power supply unit is supplied to the at least one developing cartridge.

In accordance with another embodiment of the present disclosure, an image forming apparatus includes a body, a cover, a tray, at least one developing cartridge, and a connection terminal. The cover is configured to open/close one side of the body. The tray is installed to the body through the one side open by the cover as to enable a sliding motion. At least one developing cartridge is installed at an inside of the body while accommodated at the tray and is provided at one side thereof with an interface terminal to be supplied with a power used to form an image. The connection terminal is configured to move in linkage with an open/close motion of the cover such that the connection terminal makes contact with the interface terminal when the cover closes the body and is separated from the interface terminal when the cover opens the body.

The image forming apparatus further includes a guide rail and a connection terminal plate. The guide rail is configured to guide the movement of the tray while being connected to the tray and to move in linkage with the open/close motion of the cover while being connected to cover. The connection terminal plate is configured to move in linkage with the guide rail while being connected to the guide rail, and to allow the connection terminal to make contact with the interface terminal by pressing the connection terminal or allow the connection terminal to be separated from the interface terminal by releasing a pressing force on the connection terminal.

The image forming apparatus further comprises a first link mechanism which is configured to connect the connection terminal plate to the guide rail for the connection terminal plate to move in linkage with the guide rail. The first link mechanism includes at least one first guide protrusion which is protruded from one side of the guide rail, and at least one first guide slot which is formed at the connection terminal plate to accommodate the at least one first guide protrusion such that the at least one first guide protrusion moves in a sliding manner.

The at least one first guide slot includes an inclined unit which is formed in a slanted manner with respect to a moving direction of the guide rail.

The image forming apparatus further includes a second link mechanism which is configured to connect the guide rail to the body such that the guide rail is movably coupled to one side of the body. The second link mechanism includes at least one first guide protrusion which is protruded from one side of the guide rail, and at least one second guide slot which is formed at one surface of the body to accommodate the at least one first guide protrusion such that the at least one first guide protrusion moves in a sliding manner.

The image forming apparatus further includes a third link mechanism which connects the connection terminal plate to the body such that connection terminal plate is movably coupled to one side of the body. The third link mechanism includes at least one second guide protrusion which is protruded from one side of the connection terminal plate, and at least one third guide slot which is configured to accommodate the at least one second guide protrusion such that the at least one second guide protrusion moves in a sliding manner.

The connection terminal includes a fixed unit which is fixed to a power supply unit that is provided at one side of the body for supplying a power to the at least one developing cartridge, a contact unit which is pressed by the connection terminal plate to make contact with the interface terminal, and a connection unit which is configured to connect the fixed unit to the contact unit.

The contact unit includes a contact point which is configured to make contact with the interface terminal, a first arm which is configured to connect the contact point to the connection terminal plate and to rotate on the contact point in linkage with the connection terminal plate. The second arm is configured to connect the contact point to the connection unit and to rotate on the connection unit in linkage with the first arm.

An angle formed by the first arm, the contact point, and the second arm when the connection terminal plate presses the contact unit is smaller than an angle formed when the connection terminal plate releases a pressing force on the contact unit.

Each of the contact point and the connection unit includes a coil spring.

As described above, in accordance with the embodiments of the present disclosure, the number of stages for an electrical interface between a developing cartridge and a power supply unit are reduced, thereby enhancing interface stability and reliability.

In addition, the number of components for an electrical interface between a developing cartridge and a power supply unit are reduced, thereby reducing material cost and improving productivity.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
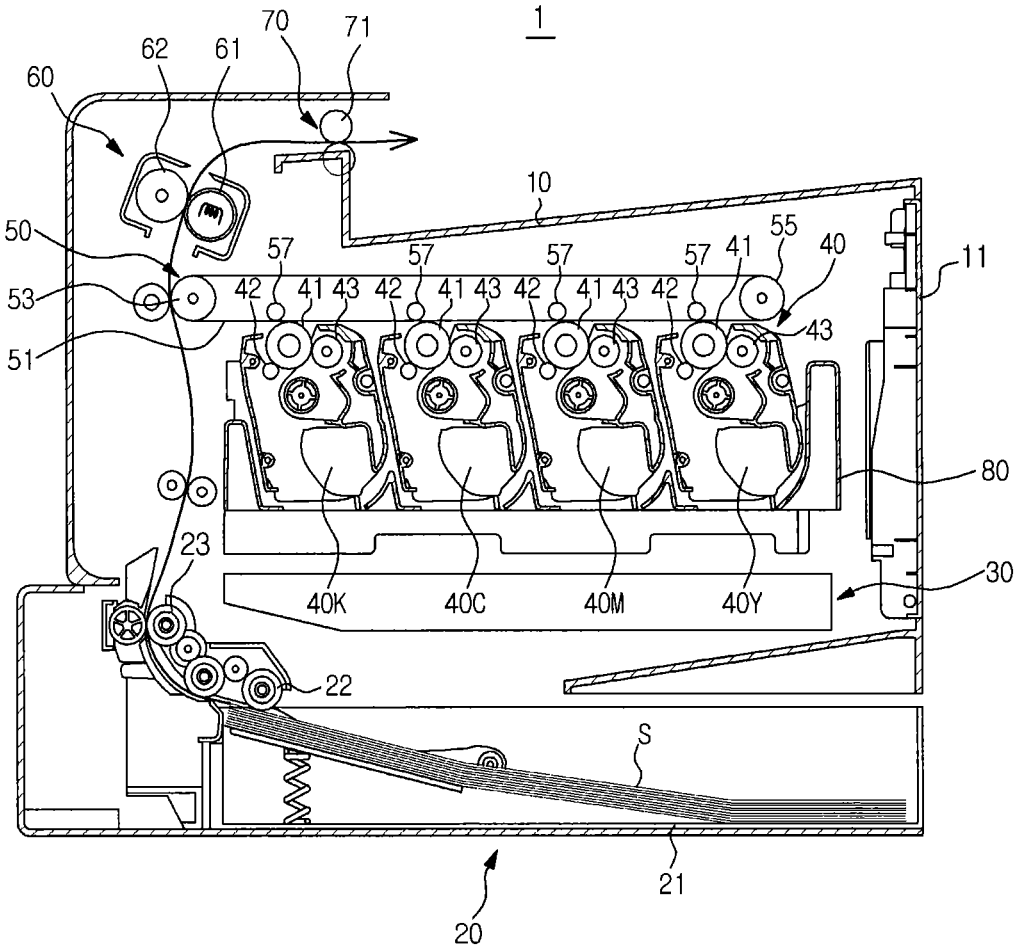
FIG. 1 is a view schematically illustrating a structure of an image forming apparatus according to one embodiment of the present invention.

Reference will now be made in detail to the embodiments of the present invention, examples of which are illustrated in the accompanying drawings, wherein like reference numerals refer to like elements throughout.

FIG. 1 is a view schematically illustrating a structure of an image forming apparatus 1 according to one embodiment of the present invention. As shown in FIG. 1, the image forming apparatus 1 includes a body 10, a printing medium supply unit 20, an optical scanning unit 30, a developing cartridge 40, a transfer unit 50, a fuser unit 60, and a printing medium discharge unit 70.

The body 10 is configured to form an exterior of the image forming apparatus 1 and support various components installed in the body 10. In addition, a cover 11 is rotatably installed on one side of the body 10. The cover 11 is configured to open/close a portion of the body 10. A user may approach the inside the body 10 through the cover 11 and detach components such as the developing cartridge 40.

The printing medium supply unit 20 includes a cassette 21 where a printing medium S is stored, a pick-up roller 22 which is configured to pick up the printing medium S one piece at a time, and a convey roller 23 which is configured to convey the printing medium S which is picked up toward the transfer unit 50.

The optical scanning unit 30 is provided at the bottom portion of the developing cartridge 40, and forms an electrostatic latent image on the surface of a photoconductor 41 by scanning light that corresponds to image related information.

The developing cartridge 40 may include four developing cartridges 40Y, 40M, 40C and 40K where each has a different color developer such as yellow Y, magenta M, cyan C, and black K accommodated therein.

Each of the developing cartridges 40Y, 40M, 40C and 40K is equipped with the photoconductor 41, a charge roller 42, a development roller 43, and a supply roller (not shown). The electrostatic latent image is formed on the surface of the photoconductor 41 by the development roller 43. The charge roller 42 charges the photoconductor 41 with a predetermined electric potential. The supply roller (not shown) supplies a developer to the development roller 43, and the development roller 43 places the developer on the surface of the photoconductor 41 at where the electrostatic latent image is formed, thereby forming a visible image.

The transfer unit 50 includes a transfer belt 51 which keeps rotating while making contact with the photoconductor 41 of each developing cartridges 40Y, 40M, 40C and 40K, a driving roller 53 to drive the transfer belt 51, a tension roller 55 to apply a constant tension on the transfer belt 51, and four rollers 57 to transfer the visible image to a printing medium P.

The fuser unit 60 is equipped with a heat roller 61 which is configured to have a heat source and a pressing roller 62 which is installed in opposition to the heat roller 61. When the printing medium S passes through between the heat roller 61 and the pressing roller 62, the visible image is fixed to the printing medium S by the heat transferred from the heat roller 61 and by the pressure applied between the heat roller 61 and the pressing roller 62.

The printing medium discharge unit 70 is equipped with a plurality of exit rollers 71 to discharge the printing medium S which passed through the fuser unit 60 to the outside of the body 10.

Each of the developing cartridges 40Y, 40M, 40C and 40K which is configured to form a visible image is accommodated at a tray 80, and the tray 80 is slidably coupled to the body 10 by a guide rail 150 which moves in linkage with the cover 11.

Figure 2:
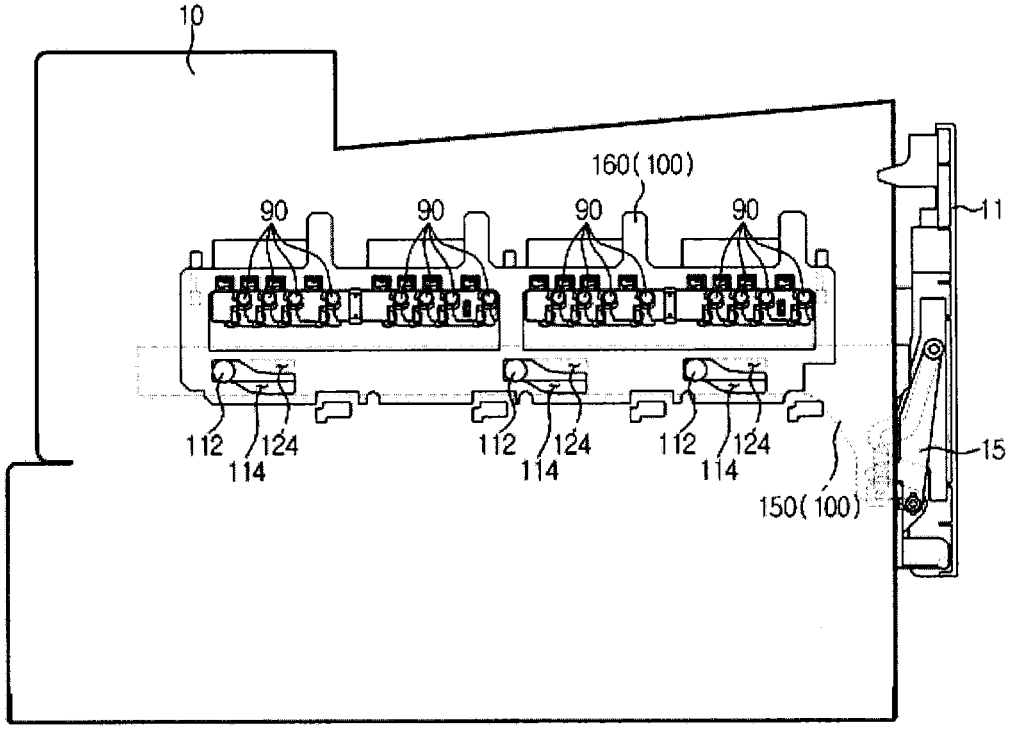
FIG. 2 is a view illustrating a state of a cover disposed at a first position at which the cover closes a body.
Figure 3:
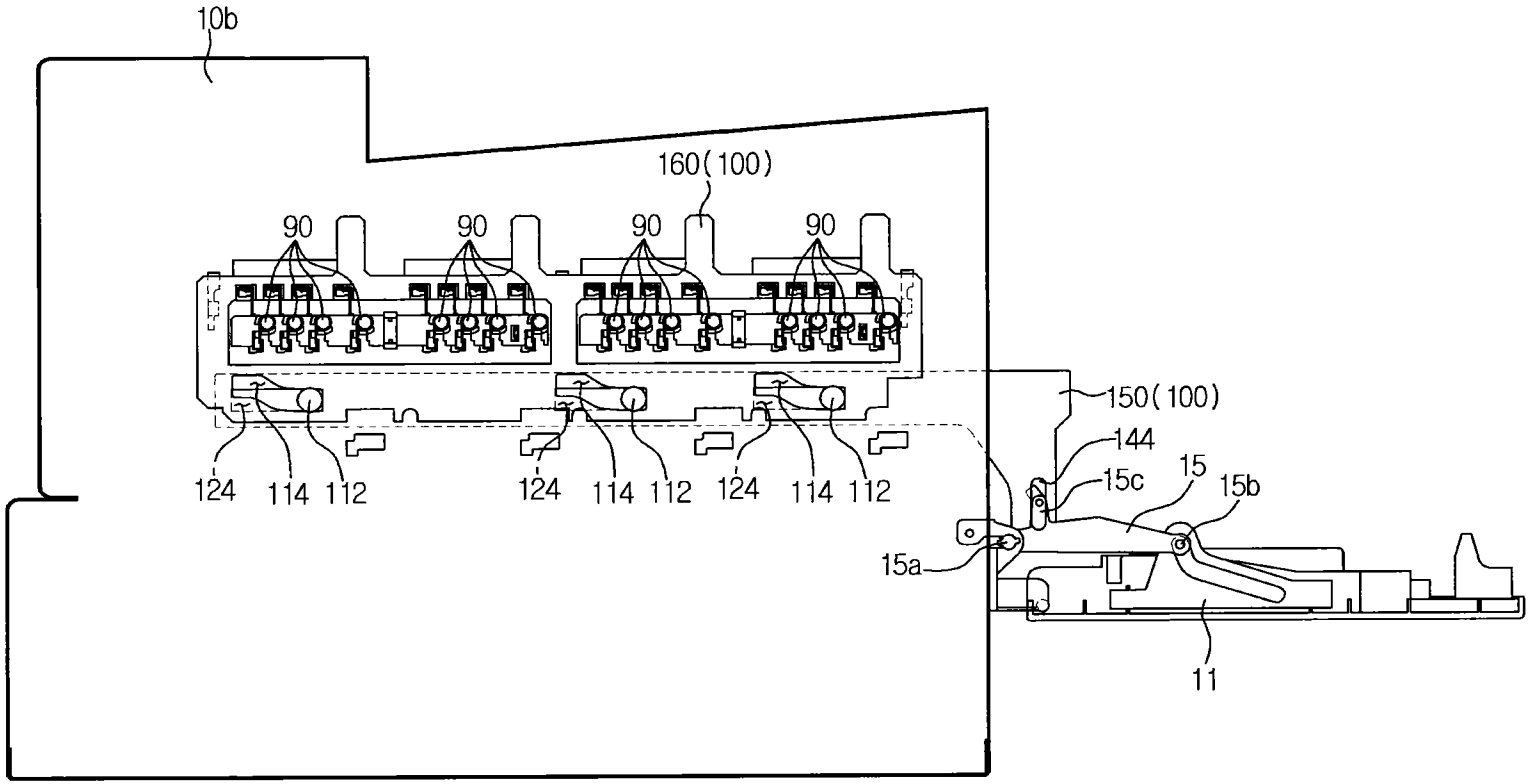
FIG. 3 is a view illustrating a state of a cover disposed at a second position at which the cover opens the body.
Figure 4:
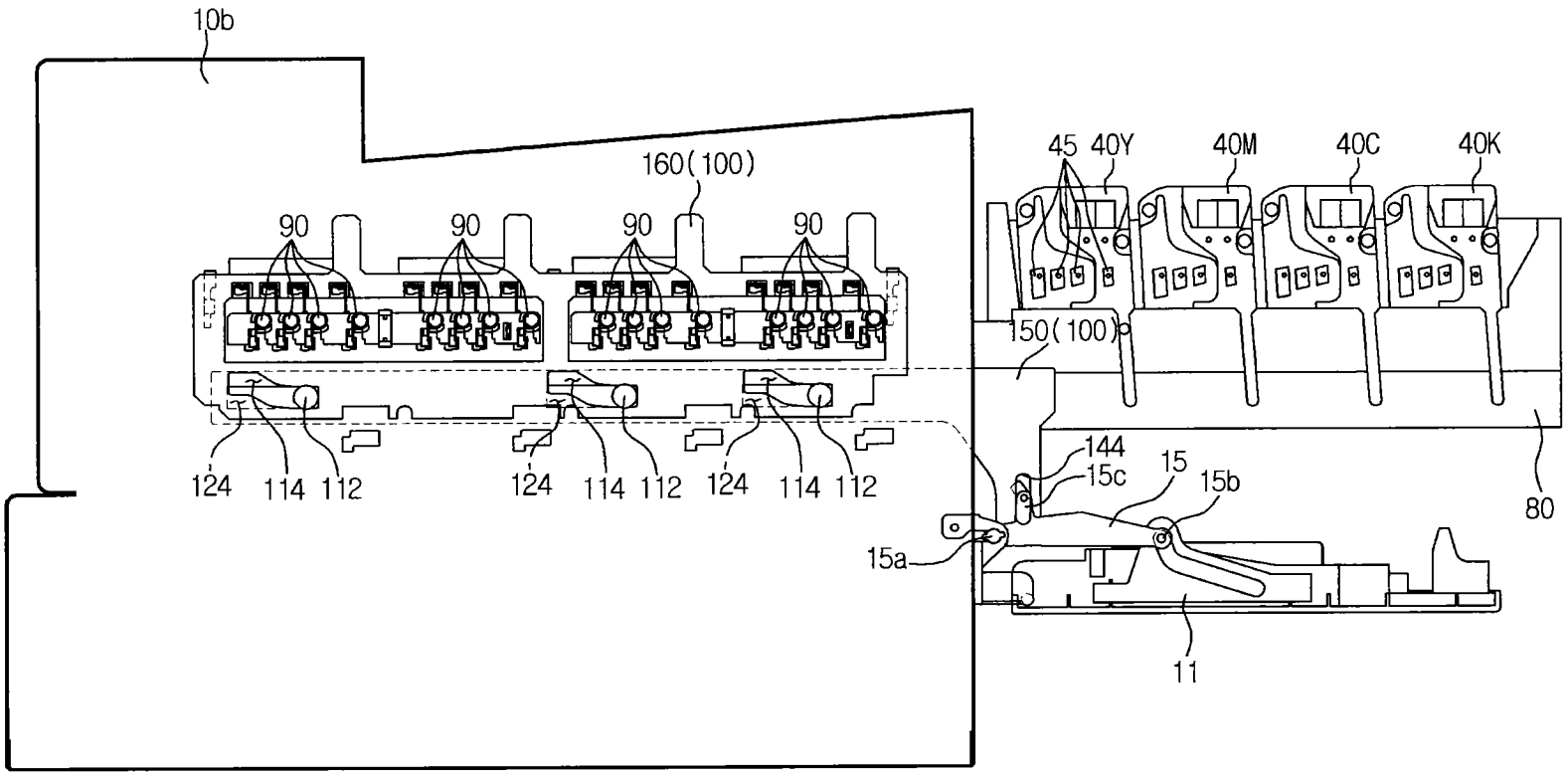
FIG. 4 is a view illustrating a state of a tray moved to an outside of the body.

FIG. 2 is a view illustrating a state of a cover 11 disposed at a first position at which the cover 11 closes a body 10. FIG. 3 is a view illustrating a state of the cover 11 disposed at a second position at which the cover 11 opens the body 10. FIG. 4 is a view illustrating a state of a tray 80 moved to an outside of the body 10.

As shown in FIGS. 2 to 4, the guide rail 150 is connected to an inner frame 10*b* of the body 10 and the cover 11, which opens/closes the body 10, to move in a sliding manner a forward/backward direction of the body 10 according to the motion of the cover 11 in opening/closing the body 10.

The guide rail 150 includes at least one first guide protrusion 112 which is protruded from one side of the guide rail 150. At least one second guide slot 124 is formed at both ends of the inner frame 10*b* in a lengthways direction toward a forward/backward direction of the body 10. The second guide slot 124 is configured to accommodate the first guide protrusion 112 to guide the first guide protrusion 112 such that the first guide protrusion 112 moves in a sliding manner toward a forward/backward direction of the body 10. The first guide protrusion112, along with the second guide slot 124, form a second link mechanism 120.

The guide rail 150, which is slidably coupled to the inner frame 10*b* through the first guide protrusion 112, is coupled to the cover 11, which is rotatably coupled to the body 10, through a connection link 15 as to enable a motion in linkage with each other.

One end 15*a* of the connection link 15 is rotatably coupled to the body 10 such that the cover 11 is capable of rotating on the one end 15*a* of the connection 1ink 15, and the other end

15*b* of the connection link 15 is slidably coupled to the cover 11 to limit a rotation angle of the cover 11, thereby preventing the cover 11 from rotating more than a certain angle.

A coupling protrusion 15*c*, which is protruded to an upper portion from a body of the connection link 15 between the one end 15*a* and the other end 15*b*, is accommodated and coupled at a fourth guide slot 144 which is formed at the guide rail 150. Accordingly, in a process of the cover 11 rotating, the guide rail 150 moves the forward/backward direction of the body 10 in linkage with the cover 11.

When a user rotates the cover 11 toward an opening direction of the body 10 to replace the developing cartridges 40Y, 40M, 40C and 40K, the connection link 15 rotates on the one end 15*a* and in a process of the connection link 15 rotating, the coupling protrusion 15*c*moves downward through the fourth guide slot 144 to move the guide rail 150 to the front of the body 10 by a predetermined distance. A user may approach to a portion of the body 10 which is open by the cover 11, pull the tray 80 which is slidably coupled to the guide rail 150, to the front of the body 10 to the extent that the developing cartridges 40Y, 40M, 40C and 40K needed for the replacement are entirely exposed, separate the developing cartridges 40Y, 40M, 40C and 40K needed for replacement from the tray 80, and replace with new developing cartridges 40Y, 40M, 40C and 40K.

After the replacement of the developing cartridges 40Y, 40M, 40C and 40K is completed, a user moves the tray 80 having the developing cartridges 40Y, 40M, 40C and 40K coupled thereto toward the inside of the body 10 and closes the body 10 by rotating the cover 11 which has the body 10 at an open state.

Meanwhile, as shown in FIG. 4, an interface terminal 45 which is provided at one side of each of the developing cartridges 40Y, 40M, 40C and 40K is exposed at an upper portion of one side of the tray 80 in a state of the developing cartridges 40Y, 40M, 40C and 40K being coupled to the tray 80.

The interface terminal 45 is configured to be electrically connected to the photoconductor 41, the development roller 43, and the like, which are included inside the developing cartridges 40Y, 40M, 40C and 40K. The interface terminal 45 delivers the power supplied from a power supply unit 98 to the photoconductor 41, the development roller 43, etc. by making direct contact with a connection terminal 90, which is fixed to the body 10, in a state of developing cartridges 40Y, 40M, 40C and 40K being mounted on the body 10.

A link member 100 which moves linkage with the cover 11 allows the interface terminal 45 to make contact with or release the contact with the connection terminal 90.

Figure 5:
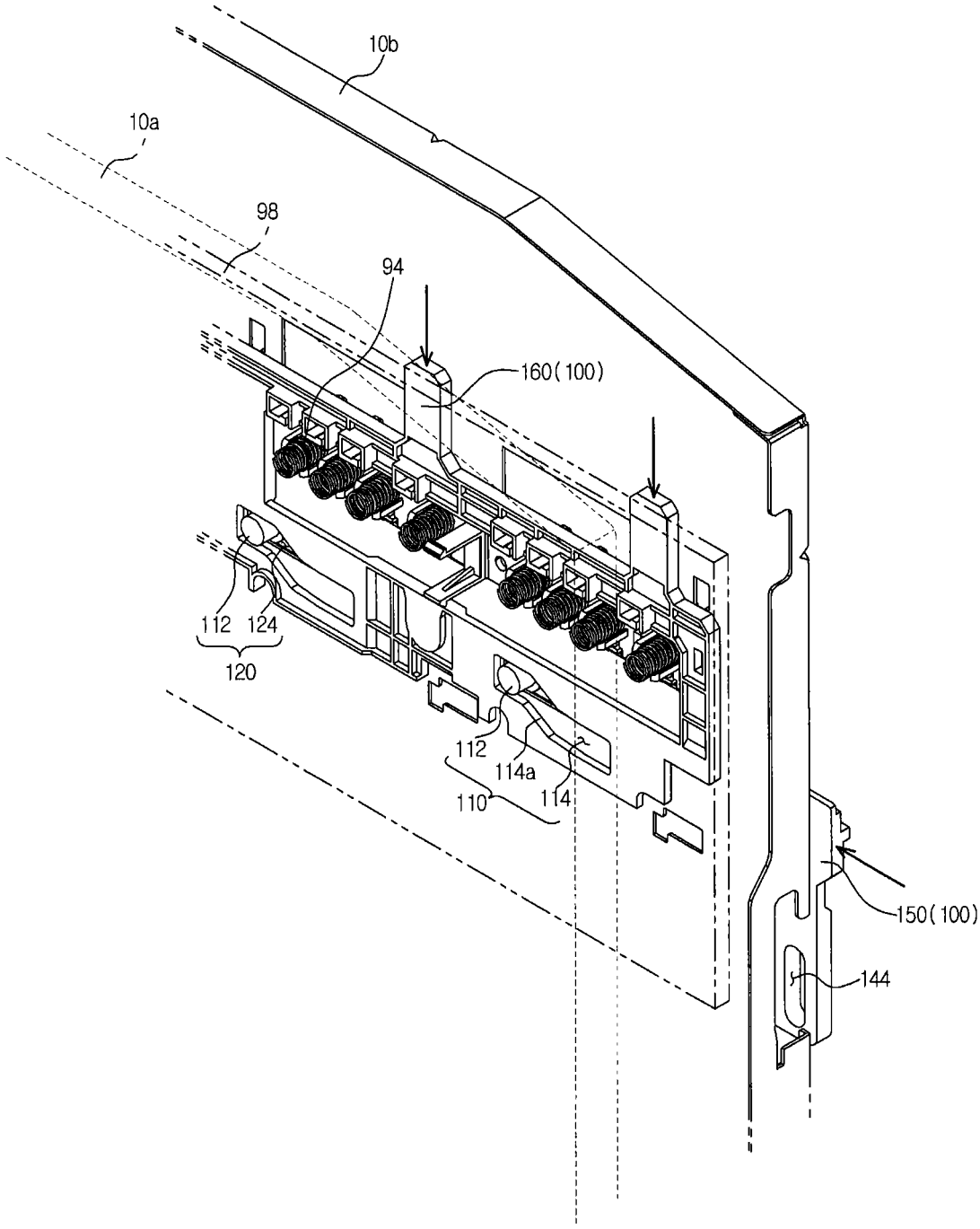
FIG. 5 is a view illustrating a coupling relation of components which interact with the cover of FIG. 2.
Figure 6:
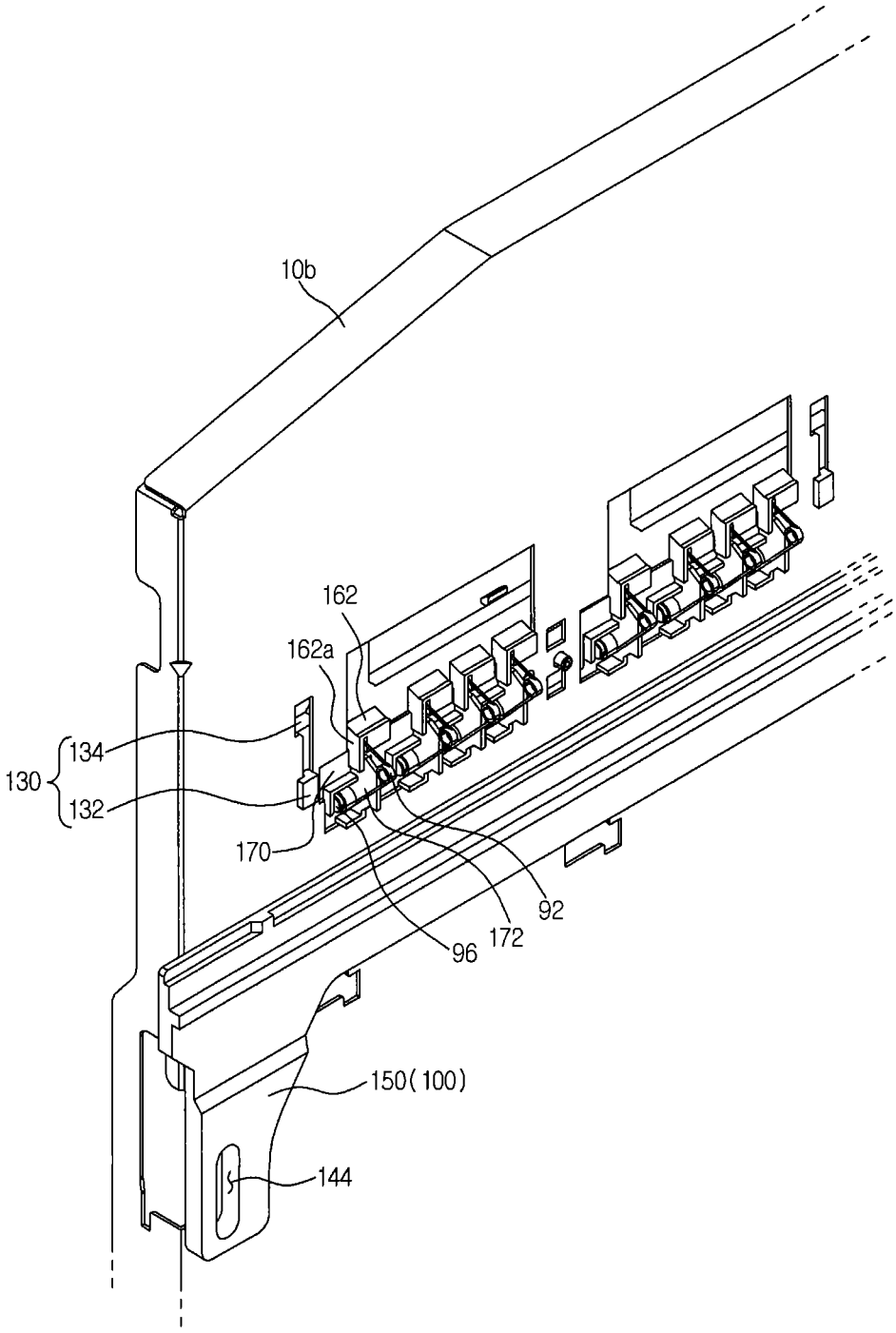
FIG. 6 is a view illustrating the coupling relation of the components which interact with the cover of FIG. 2 seen from a different angle when compared to FIG. 5.
Figure 7:
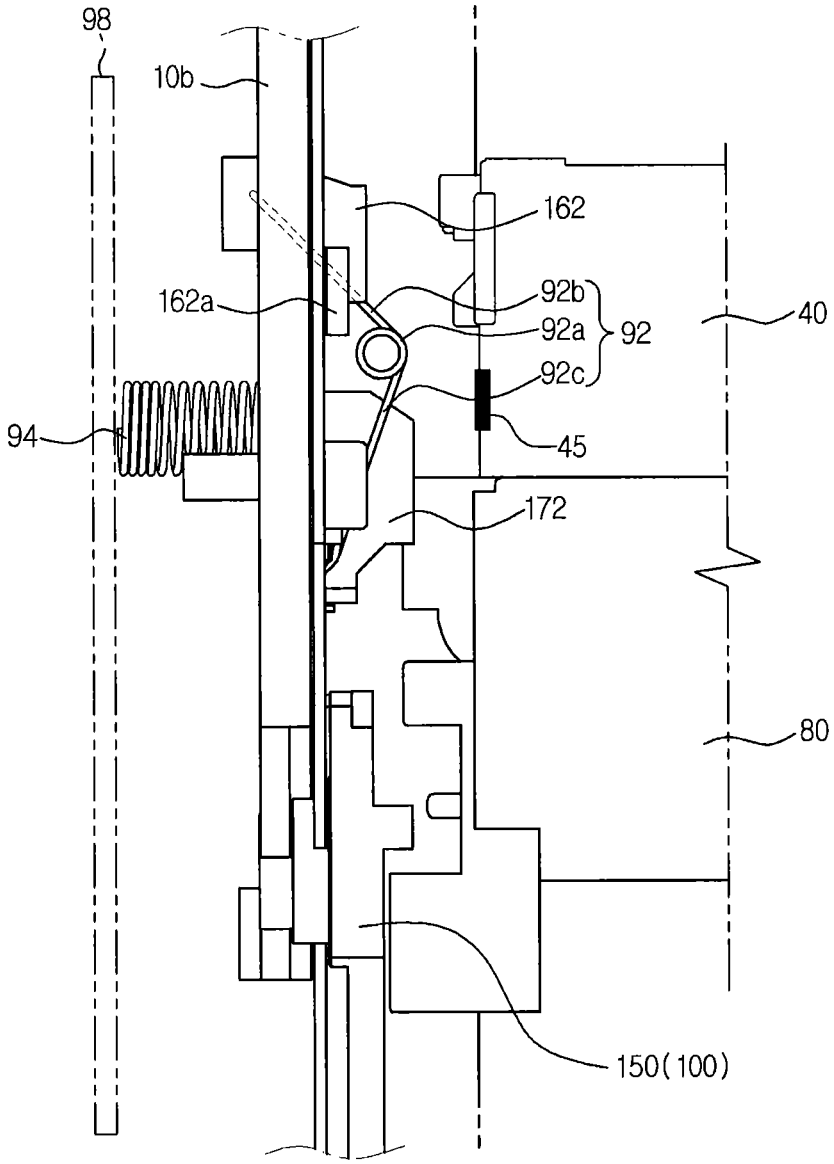
FIG. 7 is a front view of FIG. 5.
Figure 8:
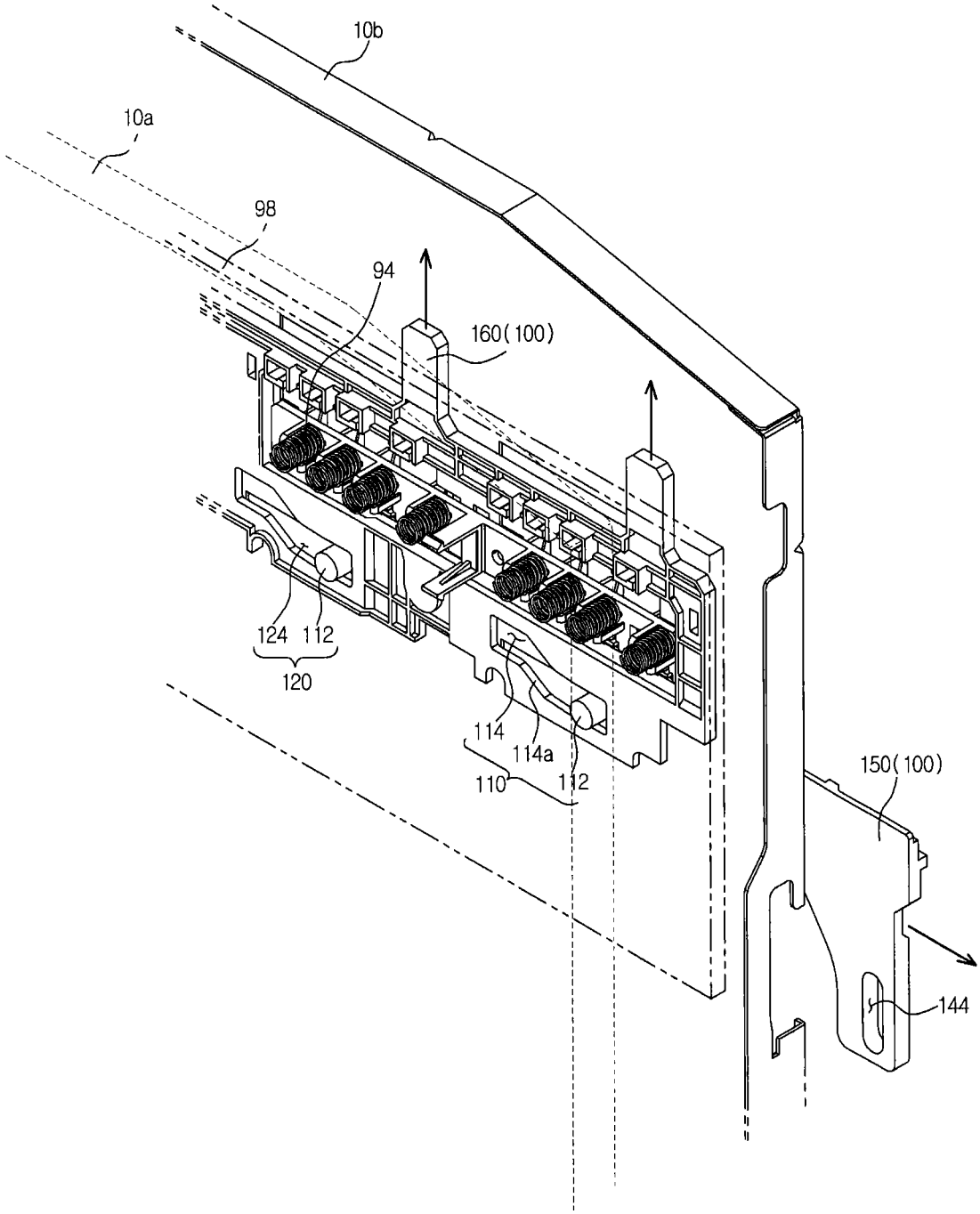
FIG. 8 is a view illustrating the coupling relation of the components which interact with the cover of FIG. 3.
Figure 9:
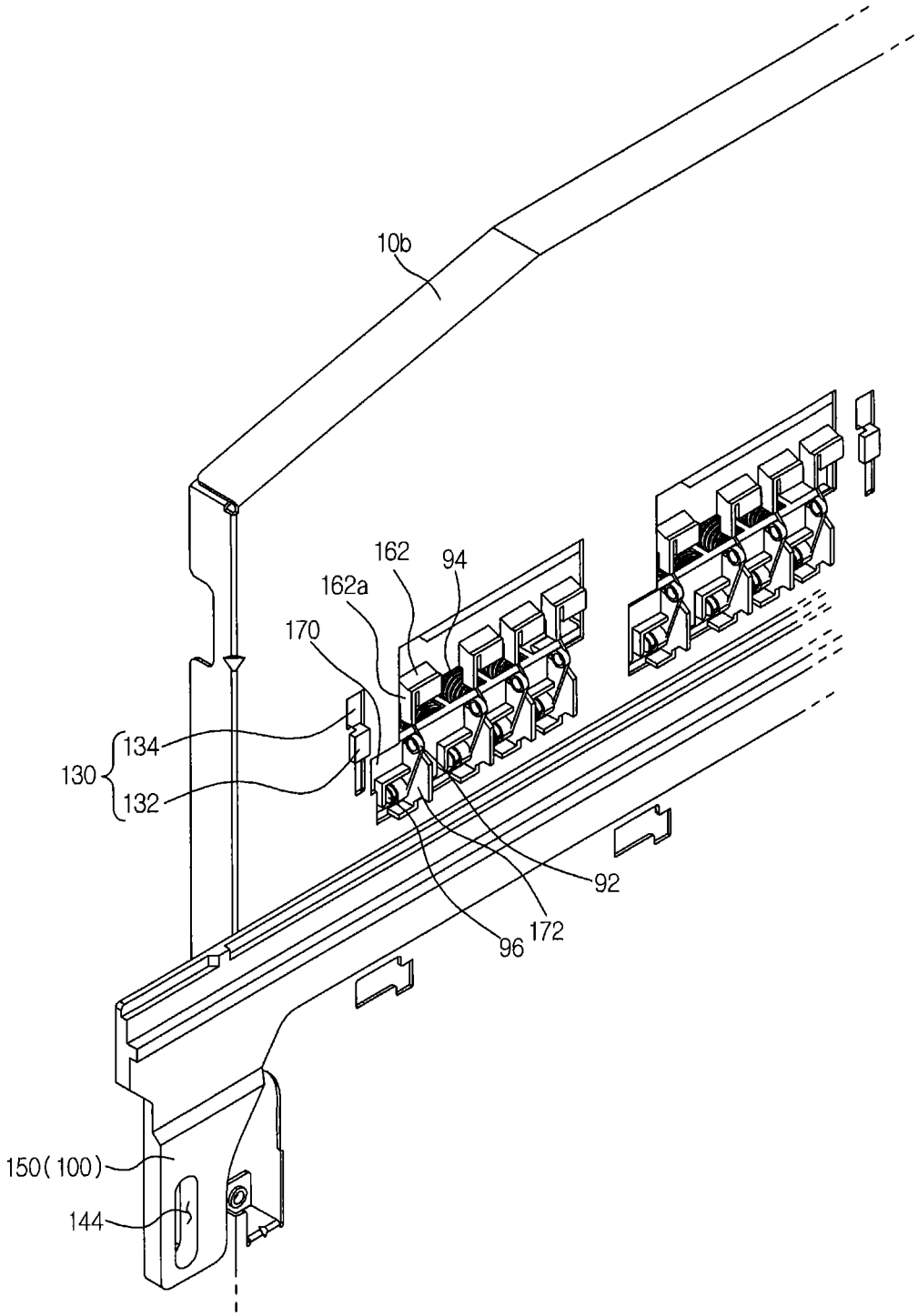
FIG. 9 is a view illustrating the coupling relation of the components which interact with the cover of FIG. 3 seen from a different angle when compared to FIG. 7.
Figure 10:
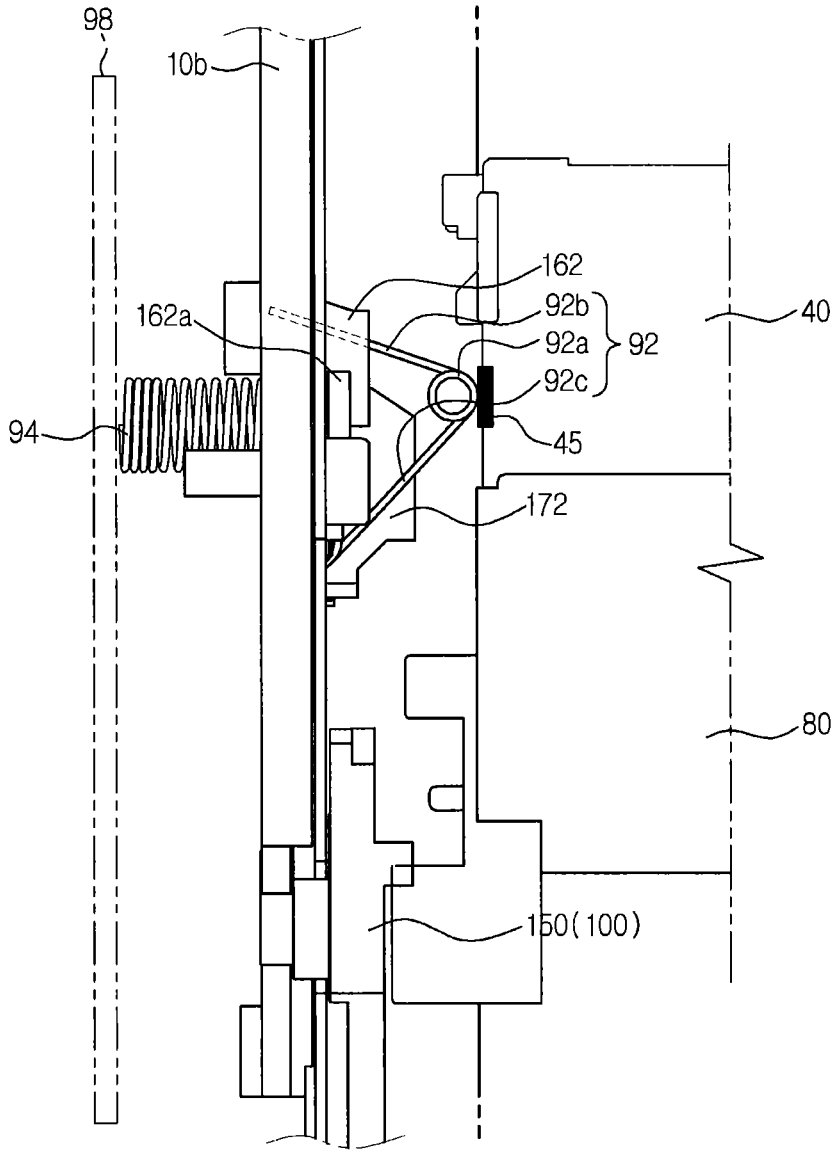
FIG. 10 is a front view of FIG. 8.

FIG. 5 is a view illustrating a coupling relation of components which interact with the cover 11 of FIG. 2. FIG. 6 is a view illustrating the coupling relation of the components which interact with the cover 11 of FIG. 2 seen from a different angle when compared to FIG. 5. FIG. 7 is a front view of FIG. 5. FIG. 8 is a view illustrating the coupling relation of the components which interact with the cover 11 of FIG. 3. FIG. 9 is a view illustrating the coupling relation of the components which interact with the cover 11 of FIG. 3 seen from a different angle when compared to FIG. 7. FIG. 10 is a front view of FIG. 8.

As shown in FIGS. 5 to 10, the link member 100 includes the guide rail 150, which moves in linkage with the cover 11, and a connection terminal plate 160, which presses the connection terminal 90 while moving in linkage with the guide rail 150. The guide rail 150 and the connection terminal plate 160 are connected to one another through a first link mechanism 110. Meanwhile, on the basis that the guide rail 150 and the connection terminal plate 160 connects the cover 11 to the connection terminal 90 such that the connection terminal 90 moves in linkage with the cover 11, the guide rail 150 and the connection terminal plate 160 are considered as a first link and a second link, respectively.

The first link mechanism 110 includes at least one guide protrusion 112 which protrudes from one side of the guide rail 150 and at least one first guide slot 114 which is provided at the connection terminal plate 160 to accommodate the first guide protrusion 112 such that the first guide protrusion 112 moves in a sliding manner. The first guide protrusion 112 is arranged in a longitudinal direction of the guide rail 150, and the first guide slot 114 is arranged at the corresponding position to the first guide protrusion 112 in a longitudinal direction of the connection terminal plate 160 for the first guide protrusion 112 to be coupled.

The first guide slot 114 includes an inclined plane 114*a* which forms a predetermined angle with respect to the moving direction of the guide rail 150. When the first guide protrusion 112 which moves in a sliding manner by following the first guide slot 114 moves on the inclined plane 114*a*, the connection terminal plate 160 ascends or descends by the height of the inclined plane 114*a*. By adjusting the angle of the inclined plane 114*a*, the forward/backward moving distance of the connection terminal plate 160 may be adjusted.

The guide rail 150 is slidably coupled to the body 10 through the second link mechanism 120.

The second link mechanism 120 includes at least one guide protrusion 112 which protrudes from one side of the guide rail 150 and at least one second guide slot 124 which is provided at both ends of the inner frame 10*b* and is formed in a lengthways direction toward a forward/backward direction of the body 10. The second guide slot 124 accommodates the first guide protrusion 112 to guide the first guide protrusion 112 such that the first guide protrusion 112 is capable of moving toward a forward/backward direction of the body 10.

The first guide protrusion 112 is coupled to the first guide slot 114 which is provided at the connection terminal plate 160 and to the second guide slot 124 which is provided at both ends of the inner frame 10*b*, to guide the guide rail 150 such that the guide rail 150 moves toward a forward/backward direction of the body 10, and at the same time, to guide the connection terminal plate 160 such that the connection terminal plate 160 moves toward a upward/downward direction of the body 10 in linkage with the guide rail 150.

The connection terminal plate 160 is slidably coupled to the inner frame 10*b* through a third link mechanism 130.

The third link mechanism 130 includes at least one second guide protrusion 132, which protrudes from one side of the connection terminal plate 160, and at least one third guide slot 134, which is provided at one end of the inner frame 10*b* and is formed in a lengthways direction toward an upward/downward direction of the body 10. The third guide slot 134 accommodates the second guide protrusion 132 to guide such that the second guide protrusion 132 is capable of moving toward an upward/downward direction of the body 10.

The connection terminal plate 160 is equipped with a pressing rib 162 which is configured to press the connection terminal 90 or release press on the connection terminal 90 in a process of the connection terminal plate 160 moving toward an upward/downward direction of the body 10. The connection terminal 90 is configured to make contact with the interface terminal 45 of the developing cartridges 40Y, 40M, 40C and 40K when the connection terminal 90 is pressed by the pressing rib 162, and is separated from the interface terminal 45 of the developing cartridges 40Y, 40M, 40C and 40K when the pressing force by the pressing rib 162 is released.

The connection terminal 90 includes a contact unit 92, a fixed unit 94, and a connection unit 96. The contact unit 92 is connected to the connection terminal plate 160 to be pressed by the connection terminal plate 160. The fixed unit 94 has one end, which is fixed to the power supply unit 98 provided between an outer frame 10*a* and the inner frame 10*b*, and the other end, which is fixed to a fixing member 170, to support the movement of the contact unit 92. The connection unit 96 is configured to connect the fixed unit 94 and the contact unit 92.

The fixed unit 94 delivers the power supplied from the power supply unit 98 to the contact unit 92 while coupling the connection terminal 90 to the inner frame 10*b*. The connection unit 96 includes a coil spring configured to elastically deform to store a force, which is applied to the contact unit 92 when the pressing rib 162 presses the contact unit 92, in the form of an elastic force. The elastic energy which is stored in the connection unit 96 when the contact unit 92 is pressed by the pressing rib 162 is used for restoring the shape of the contact unit 92 when the pressing force by the pressing rib 162 is released.

The contact unit 92 includes a contact point 92*a* which is configured to make contact with the interface terminal 45 of the developing cartridges 40Y, 40M, 40C and 40K installed at the body 10, a first arm 92*b* which is extended from the contact point 92*a* and is connected to the pressing rib 162, and a second arm 92*c* which is configured to connect between the connection unit 96 and the contact point 92*a*. The contact point 92*a*, similar to the connection unit 96, may include a coil spring configured to elastically deform to store a force applied to the contact unit 92 when the contact unit 92 is pressed by the pressing rib 162 in the form of an elastic energy. The elastic energy which is stored in the connection unit 96 when the contact unit 92 is pressed by the pressing rib 162 is used for restoring the shape of the contact unit 92 when the pressing force by the pressing rib 162 is released.

When the first arm 92*b* which is connected to the pressing rib 162 is pressed as the connection terminal plate 160 moves downward, the first arm 92*b* rotates on the contact point 92*a*, the second arm 92*c* rotates on the connection unit 96, and the angle formed by the first arm 92*b*, the contact point 92*a* and the second arm 92*c* gradually becomes smaller, and thus the contact point 92*a* moves toward a direction facing the inside of the body 10 until the contact point 92*a* makes contact with the interface terminal 45. When the pressing on the first arm 92*b* is released as the connection terminal plate 160 moves upward, the first arm 92*b*rotates on the contact point 92*a*, the second arm 92*c* rotates on the connection unit 96, and the angle formed by the first arm 92*b*, the contact point 92*a* and the second arm 92*c* gradually becomes larger, and thus the contact point 92*a* separates from the interface terminal 45 to return to its original position.

The pressing rib 162 includes a first regulation unit 162*a* which is configured to support a portion of the first arm 92*b* to regulate the moving direction of the first arm 92*b* when the first arm 92*b* rotates. The fixing member 170 includes a second regulation unit 172 which is configured to support a portion of the second arm 92*c* to regulate the moving direction of the second arm 92*c* when the second arm 92*c* rotates. In regulating the movement of the first arm 92*b* and the second arm 92*c*, the first regulation unit 162*a* and the second regulation unit 172 support each of the first arm 92*b* and the second arm 92*c* to an opposite direction, respectively, to enable the contact point 92*a* to make precise contact with the interface terminal 45 in a process of the contact point 92*a* being pressed and deformed.

Hereafter, the mechanism of the interface terminal 45 and the connection terminal 90 in contacting or separating from one another according to the open/close motion of the cover 11 will be explained with reference to the accompanied drawings.

In a state that the developing cartridges 40Y, 40M, 40C and 40K are installed inside the body 10, when the body 10 is closed by rotating the cover 11 which has the body 10 at an open state, the cover 11 and the guide rail 150 moves in a sliding manner to the rear of the body 10 through the second link mechanism 120. At the time, the connection terminal plate 160 connected to the guide rail 150 moves downward in a sliding manner through the first link mechanism 110, and at the same time the contact unit 92 of the connection terminal 90 which is connected to the connection terminal plate 160 is pressed , and makes direct contact with the interface terminal 45 of the developing cartridges 40Y, 40M, 40C and 40K, thereby delivering the power supplied from the power supply unit 98 to the interface terminal 45, and thus forming a driving electric potential on the visible photoconductor 41 and the development roller 43, which are electrically connected to the interface terminal 45, for forming an image.

When the body 10 is open by rotating the cover 11 which has the body 10 at a closed state to replace the developing cartridges 40Y, 40M, 40C and 40K, the guide rail 150 connected to the cover 11 moves in a sliding manner to the front of the body 10 through the second link mechanism 120. At the same time when the guide rail 150 is moved in a sliding manner to the front of the body 10, the connection terminal plate 160 connected to the guide rail 150 moves upward in a sliding manner through the first link mechanism 110, and also at the same time, as the pressing force on the contact unit 92 of the connection terminal 90 connected to the connection terminal plate 160 is released, the contact unit 92 is separated from the interface terminal 45 of the developing cartridges 40Y, 40M, 40C and 40K and returns to its original position.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a body;

a cover which is configured to open/close one side of the body;

a tray which is installed to the body through the one side open by the cover as to enable a sliding motion in a first direction;

at least one developing cartridge which is installed at an inside of the body while being accommodated at the tray and which is provided at one side with an interface terminal to be supplied with a power used to form an image;

a connection terminal plate which is configured to slidably move in a second direction different from the first direction in linkage with an open/close motion of the cover; and a connection terminal which is coupled to the connection terminal plate such that the connection terminal makes contact with the interface terminal while being pressed by the connection terminal plate when the cover closes the body, and the connection terminal is separated from the interface terminal while being released from a pressing force by the connection terminal plate when the cover opens the body.

2. The image forming apparatus of claim 1, further comprising:

a guide rail which is movably coupled to one side of the body and moves in linkage with the cover white connected to the cover, wherein the connection terminal plate presses the connection terminal or releases a pressing force on the connection terminal while moving in linkage with the guide rail.

3. The image forming apparatus of claim 2, wherein the guide rail comprises at least one first guide protrusion which protrudes from one side of the guide rail, and the connection terminal plate comprises at least one first guide slot which accommodates the at least one first guide protrusion such that the at least one first guide protrusion moves in a sliding manner.

4. The image forming apparatus of claim 3, wherein the at least one first guide slot comprises an inclined unit which is slanted with respect to the first direction to which the guide rail moves.

5. The image forming apparatus of claim 4, wherein at least one second guide slot is provided at one side of the body to accommodate and guide the at least one first guide protrusion such that the guide rail moves in the first direction.

6. The image forming apparatus of claim 5, wherein the connection terminal plate comprises at least one second guide protrusion which protrudes to one side of the connection terminal plate, and at least one third guide slot is provided at one side of the body to accommodate and guide the at least one second guide protrusion such that the connection terminal plate moves in the first direction.

7. The image forming apparatus of claim 1, further comprising a power supply unit which is installed on the body to supply a power to the at least one developing cartridge installed at the body, wherein the connection terminal comprises:

a fixed unit which is fixed to the power supply unit, a contact unit which makes contact with the interface terminal while being pressed by the connection terminal plate, and a connection unit which connects the fixed unit to the contact unit.

8. The image forming apparatus of claim 7, wherein the connection unit includes a coil spring which is configured to elastically deform to store a force, which is applied to the contact unit when the connection terminal plate presses the contact unit.

9. The image forming apparatus of claim 8, wherein the connection terminal plate comprises a pressing rib which is connected to the contact unit to press the contact unit or release a pressing force on the contact unit in a process that the connection terminal plate moves.

10. The image forming apparatus of claim 9, wherein the contact unit comprises:

a contact point which make direct contact with the interface terminal, a first arm which is extended from the contact point and is connected to the pressing rib, and a second arm which connects between the connection unit and the contact point.

11. The image forming apparatus of claim 10, wherein the first arm rotates on the contact point, and the second arm rotates on the connection unit.

12. The image forming apparatus of claim 11, wherein the contact point includes a coil spring which is configured to elastically deform to store a force, which is applied to the first arm when the pressing rib presses the first arm.

13. The image forming apparatus of claim 12, wherein the pressing rib comprises a first regulation unit which supports a portion of the first arm to regulate a moving direction of the first arm when the first arm rotates on the contact point.

14. The image forming apparatus of claim 13, further comprising a fixing member configured to fix the connection terminal to the body, wherein the fixing member comprises a second regulation unit which supports a portion of the second arm to regulate a moving direction of the second arm when the second arm rotates on the connection unit.

15. An image forming apparatus comprising:

a body;

a cover which is configured to open/close one side of the body;

a tray which is installed to the body through the one side open by the cover as to enable a sliding motion;

at least one developing cartridge which is installed at an inside of the body while accommodated at the tray and which is provided at one side thereof with an interface terminal to be supplied with a power used to form an image;

a power supply unit which is configured to supply a power to the at least one developing cartridge installed at the body; and a connection terminal which is connected to the power supply unit and is configured to make contact or to separate from the interface terminal in linkage with the cover, wherein when the cover opens the body, the connection terminal is separated from the interface terminal of the at least one developing cartridge to prevent the connection terminal from interfering with the at least one developing cartridge installed at the tray in a process of moving the tray.

16. The image forming apparatus of claim 15, wherein when the cover closes the body, the connection terminal makes contact with the interface terminal such that the power of the power supply unit is supplied to the at least one developing cartridge.

17. An image forming apparatus comprising:

a body;

a cover which is configured to open/close one side of the body;

a tray which is installed to the body through the one side open by the cover as to enable a sliding motion;

at least one developing cartridge which is installed at an inside of the body while accommodated at the tray and is provided at one side thereof with an interface terminal to be supplied with a power used to form an image; and a connection terminal which is configured to move in linkage with an open/close motion of the cover such that the connection terminal makes contact with the interface terminal when the cover closes the body and is separated front the interface terminal when the cover opens the body.

18. The image forming apparatus of claim 17, further comprising:

a guide rail which is configured to guide the movement of the tray while being connected to the tray and to move in linkage with the open/close motion of the cover while being connected to the cover; and a connection terminal plate which is configured to move in linkage with the guide rail while being connected to the guide rail and to allow the connection terminal to make contact with the interface terminal by pressing the connection terminal or allow the connection terminal to be separated from the interface terminal by releasing a pressing force on the connection terminal.

19. The image forming apparatus of claim 18 further comprising:

a first link mechanism which is configured to connect the connection terminal plate to the guide rail for the connection terminal plate to move in linkage with the guide rail, wherein the first link mechanism comprises:

at least one first guide protrusion which is protruded from one side of the guide rail, and at least one first guide slot which is formed at the connection terminal plate to accommodate the at least one first guide protrusion such that the at least one first guide protrusion moves in a sliding manner.

20. The image forming apparatus of claim 19, wherein the at least one first guide slot comprises an inclined unit which is formed in a slanted manner with respect to a moving direction of the guide rail.

21. The image forming apparatus of claim 20, further comprising a second link mechanism which is configured to connect the guide rail to the body such that the guide rail is movably coupled to one side of the body, wherein the second link mechanism comprises:

at least one first guide protrusion which is protruded from one side of the guide rail, and at least one second guide slot which is formed at one surface of the body to accommodate the at least one first guide slot such that the at least one first guide protrusion moves in a sliding manner.

22. The image forming apparatus of claim 21, further comprising a third link mechanism which connects the connection terminal plate to the body such that the connection terminal plate is movably coupled to one side of the body, wherein the third link mechanism comprises:

at least one second guide protrusion which is protruded from one side of the connection terminal plate, and at least one third guide slot which is configured to accommodate the at least one second guide protrusion such that the at least one second guide protrusion moves in a sliding manner.

23. The image forming apparatus of claim 22, wherein the connection terminal comprises:

a fixed unit which is fixed to a power supply unit that is provided at one side of the body for supplying a power to the at least one developing cartridge, a contact unit which is pressed by the connection terminal plate to make contact with the interface terminal, and a connection unit which is configured to connect the fixed unit to the contact unit.

24. The image forming apparatus of claim 23, wherein the contact unit comprises:

a contact point which is configured to make contact with the interface terminal, a first arm which is configured to connect the contact point to the connection terminal plate and to rotate on the contact point in linkage with the connection terminal plate, and a second arm which is configured to connect the contact point with the connection unit and to rotate on the connection unit in linkage with the first arm.

25. The image forming apparatus of claim 24, wherein an angle formed by the first arm, the contact point, and the second arm when the connection terminal plate presses the contact unit is smaller than an angle formed when the connection terminal plate releases a pressing force on the contact unit.

26. The image forming apparatus of claim 25, wherein each of the contact point and the connection unit includes a coil spring.

27. An image forming apparatus comprising:

a cover which is configured to open/close one side of a body;

at least one developing cartridge which is installed at an inside of the body while accommodated at a tray and is provided at one side thereof with an interface terminal to be supplied with a power used to form an image;

a connection terminal plate which is configured to slidably move in a second direction different from a first direction in linkage with an open/close motion of the cover; and a guide rail which is movably coupled to one side of the body and moves in linkage with the cover while connected to the cover, wherein the connection terminal plate presses a connection terminal or releases a pressing force on the connection terminal pressing while moving in linkage with the guide rail, wherein the guide rail is slidable in a back and forth direction and the connection terminal plate is slidable in a back and forth direction different than the directional movement of the guide rail.

* * * * *

UNITED STATES PATENT AND TRADEMARK OFFICE

CERTIFICATE OF CORRECTION

PATENT NO. : 8,897,664 B2
APPLICATION NO. : 13/551985
DATED : November 25, 2014
INVENTOR(S) : Mun Hyub Choi et al.

It is certified that error appears in the above-identified patent and that said Letters Patent is hereby corrected as shown below:

On the Title Page

Column 2, Item [56] (Other Publications), Line 1, Insert -- International Search Report mailed January 31, 2013 for corresponding International Application No. PCT/KR2012/005745. --.

In the Claims

Column 11, line 4, In Claim 2, delete “white” and insert -- while --, therefor.
Column 12, line 55, In Claim 17, delete “front” and insert -- from --, therefor.

Signed and Sealed this
Second Day of June, 2015

Michelle K. Lee

Michelle K. Lee
*Director of the United States Patent and Trademark Office*